US009127816B2

(12) United States Patent
Kuenzler et al.

(10) Patent No.: US 9,127,816 B2
(45) Date of Patent: Sep. 8, 2015

(54) LED LIGHT ENGINE/HEAT SINK ASSEMBLY

(75) Inventors: Glenn H. Kuenzler, Beachwood, OH (US); Charles L. Huddleston, II, Cleveland, OH (US); Jeremias A. Martins, Twinsburg, OH (US); Ashfaqul I. Chowdhury, Broadview Heights, OH (US); Gary R. Allen, Chesterland, OH (US)

(73) Assignee: GE LIGHTING SOLUTIONS, LLC, Cleveland, OH (US)

( * ) Notice: Subject to any disclaimer, the term of this patent is extended or adjusted under 35 U.S.C. 154(b) by 0 days.

(21) Appl. No.: 13/323,038

(22) Filed: Dec. 12, 2011

(65) Prior Publication Data

US 2012/0182737 A1 Jul. 19, 2012

Related U.S. Application Data

(60) Provisional application No. 61/434,048, filed on Jan. 19, 2011.

(51) Int. Cl.

| | |
|---|---|
| ***F21S 4/00*** | (2006.01) |
| ***F21V 21/00*** | (2006.01) |
| ***F21V 29/00*** | (2006.01) |
| ***H01R 33/00*** | (2006.01) |
| ***F21K 99/00*** | (2010.01) |
| ***F21V 19/00*** | (2006.01) |
| ***F21V 29/74*** | (2015.01) |

(Continued)

(52) U.S. Cl.

CPC ..... *F21K 9/135* (2013.01); *F21V 19/003* (2013.01); *F21V 19/0035* (2013.01); *F21V 29/004* (2013.01); *F21V 29/74* (2015.01); *F21V 29/78* (2015.01); *F21Y 2101/02* (2013.01); *Y10T 29/49945* (2015.01)

(58) Field of Classification Search

CPC ... F21K 9/135; F21K 19/0035; F21K 29/004; F21K 29/2206; F21K 9/1335; F21K 9/1375; F21K 15/01; F21K 15/011

USPC ..... 362/294, 249.02, 373, 650

See application file for complete search history.

(56) References Cited

U.S. PATENT DOCUMENTS

| | | | | |
|---|---|---|---|---|
| 2,188,356 | A * | 1/1940 | Jeans et al. | 411/11 |
| 2,756,271 | A * | 7/1956 | Merriman | 174/177 |

(Continued)

FOREIGN PATENT DOCUMENTS

| | | |
|---|---|---|
| DE | 10 2007 03782 | 2/2009 |
| EP | 1914470 A1 | 4/2008 |
| EP | 2105659 A1 | 9/2009 |

OTHER PUBLICATIONS

"Graphite Thermal Spreaders . . . PYROID Pyrolytic".*

(Continued)

*Primary Examiner* — Y M Lee
*Assistant Examiner* — Erin Kryukova
(74) *Attorney, Agent, or Firm* — Fay Sharpe LLP

(57) ABSTRACT

According to a first embodiment, a light emitting diode (LED) light engine is described. The light emitting diode includes one or more LED devices disposed on a front side of an LED light engine substrate. A heat sink having a mating receptacle for the LED light engine is also provided. The LED light engine substrate and the mating receptacle of the heat sink define a tapered fitting by which the LED light engine is retained in the mating receptacle of the heat sink.

23 Claims, 10 Drawing Sheets

(51) Int. Cl.
*F21V 29/78* (2015.01)
*F21Y 101/02* (2006.01)

(56) References Cited

U.S. PATENT DOCUMENTS

| | | | | |
|---|---|---|---|---|
| 5,143,411 | A * | 9/1992 | Watts | 285/333 |
| 5,360,239 | A * | 11/1994 | Klementich | 285/94 |
| 6,030,103 | A * | 2/2000 | Gampe et al. | 362/404 |
| 8,115,369 | B2 * | 2/2012 | Kang et al. | 313/45 |
| 8,567,987 | B2 * | 10/2013 | Wronski | 362/236 |
| 2006/0034077 | A1 | 2/2006 | Chang | |
| 2006/0098440 | A1 * | 5/2006 | Allen | 362/294 |
| 2006/0139932 | A1 * | 6/2006 | Park | 362/294 |
| 2007/0230186 | A1 * | 10/2007 | Chien | 362/294 |
| 2008/0106907 | A1 * | 5/2008 | Trott et al. | 362/368 |
| 2008/0158887 | A1 | 7/2008 | Zhu et al. | |
| 2008/0186704 | A1 * | 8/2008 | Chou et al. | 362/249 |
| 2009/0080187 | A1 * | 3/2009 | Chou | 362/231 |
| 2009/0086484 | A1 | 4/2009 | Johnson | |
| 2009/0195186 | A1 * | 8/2009 | Guest et al. | 315/294 |
| 2010/0103675 | A1 | 4/2010 | Yu et al. | |
| 2010/0314986 | A1 * | 12/2010 | Gershaw | 313/46 |
| 2011/0069500 | A1 * | 3/2011 | Meyer et al. | 362/373 |
| 2011/0248619 | A1 * | 10/2011 | Loh | 313/46 |
| 2012/0033429 | A1 * | 2/2012 | Van De Ven | 362/294 |
| 2013/0010481 | A1 * | 1/2013 | Qin | 362/382 |

OTHER PUBLICATIONS

"Thermal Conductivity of some common Materials and Gases" accessed by www.engineeringtoolbox.com/thermal-conductivity-d_429.html on Apr. 24, 2014.*

PCT Search Report and Written Opinion dated May 8, 2012 from corresponding Application No. PCT/US2011/066474.

Unofficial English translation of MX Office Action issued Mar. 28, 2014 in connection with corresponding MX Patent Application No. MX/a/2013/008428.

* cited by examiner

LED LIGHT ENGINE/HEAT SINK ASSEMBLY

This application claims the benefit of U.S. Ser. No. 61/434,048 filed Jan. 19, 2011. The disclosure of which is herein incorporated by reference.

BACKGROUND

The following relates to the illumination arts, lighting arts, solid state lighting arts, lamp and luminaire arts, and related arts.

Conventional incandescent, halogen, and high intensity discharge (HID) light sources have relatively high operating temperatures, and as a consequence heat egress is dominated by radiative and convective heat transfer pathways. For example, radiative heat egress goes with temperature raised to the fourth power, so that the radiative heat transfer pathway becomes superlinearly more dominant as operating temperature increases. Accordingly, thermal management for incandescent, halogen, and HID light sources typically amounts to providing adequate air space proximate to the lamp for efficient radiative and convective heat transfer. Typically, in these types of light sources, it is not necessary to increase or modify the surface area of the lamp to enhance the radiative or convective heat transfer in order to achieve the desired operating temperature of the lamp.

Light-emitting diode (LED)-based lamps, on the other hand, typically operate at substantially lower temperatures for device performance and reliability reasons. For example, the junction temperature for a typical LED device should be below 200° C., and in some LED devices should be below 100° C. or even lower. At these low operating temperatures, the radiative heat transfer pathway to the ambient is weak compared with that of conventional light sources, so that convective and conductive heat transfer to ambient typically dominate over radiation. In LED light sources, the convective and radiative heat transfer from the outside surface area of the lamp or luminaire can both be enhanced by the addition of a heat sink.

A heat sink is a component providing a large surface for radiating and convecting heat away from the LED devices. In a typical design, the heat sink is a relatively massive metal element having a large engineered surface area, for example by having fins or other heat dissipating structures on its outer surface. The large mass of the heat sink efficiently conducts heat from the LED devices to the heat fins, and the large area of the heat fins provides efficient heat egress by radiation and convection. For high power LED-based lamps it is also known to employ active cooling using fans or synthetic jets or heat pipes or thermo-electric coolers or pumped coolant fluid to enhance the heat removal.

BRIEF DESCRIPTION

According to a first embodiment, a light emitting diode (LED) light engine is described. The light emitting diode includes one or more LED devices disposed on a front side of an LED light engine substrate. A heat sink having a mating receptacle for the LED light engine is also provided. The LED light engine substrate and the mating receptacle of the heat sink define a tapered fitting by which the LED light engine is retained in the mating receptacle of the heat sink.

According to a further embodiment, a method for constructing a light emitting diode (LED) light engine is provided. The method comprises pressing together an LED light engine and a mating receptacle of a heat sink wherein the pressing at least contributes to engaging a tapered fitting by which the LED light engine is retained in the mating receptacle of the heat sink.

DETAILED DESCRIPTION

Figure 1:
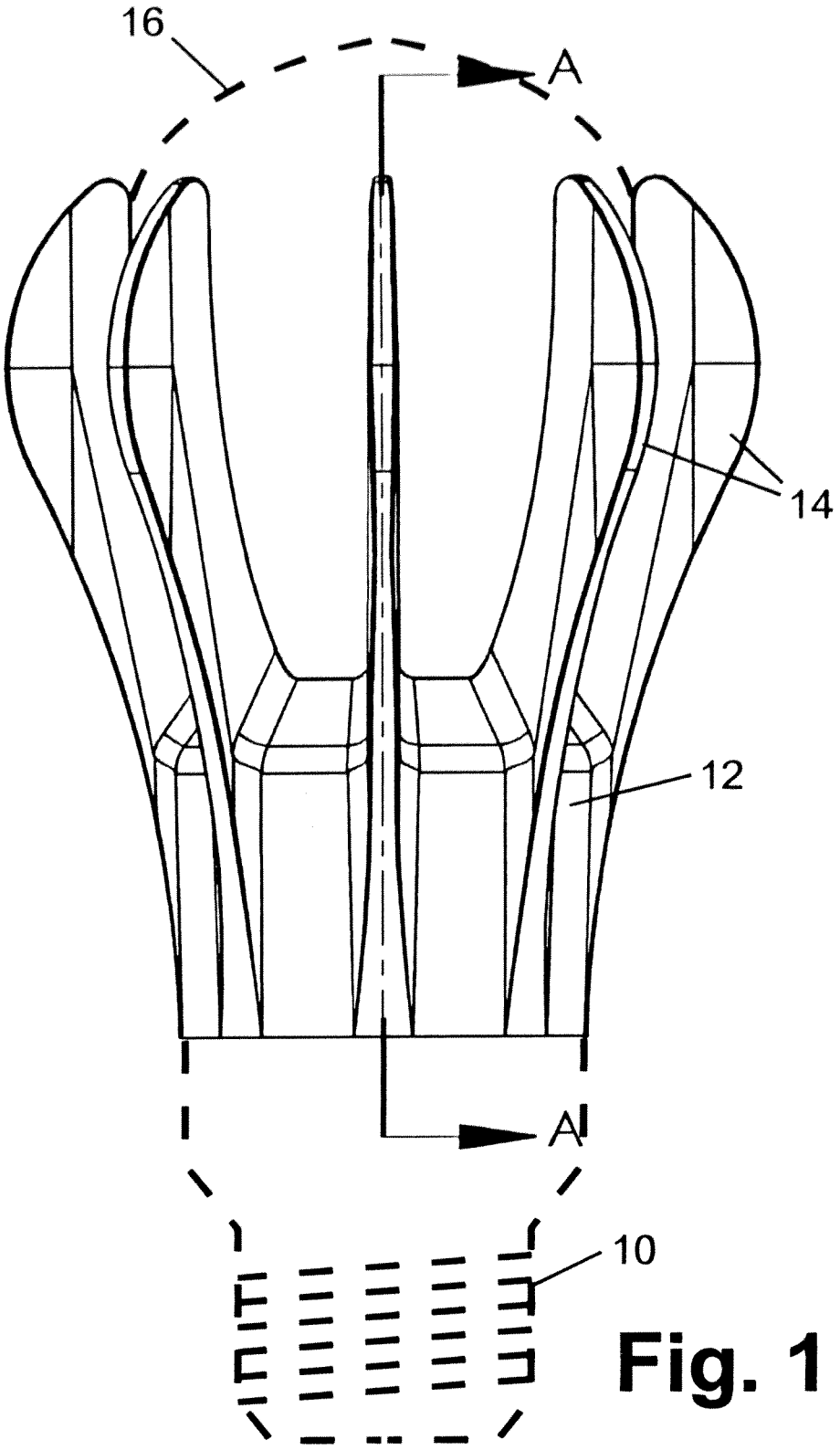
FIG. 1 is a side elevation view of the subject lamp.
Figure 2:
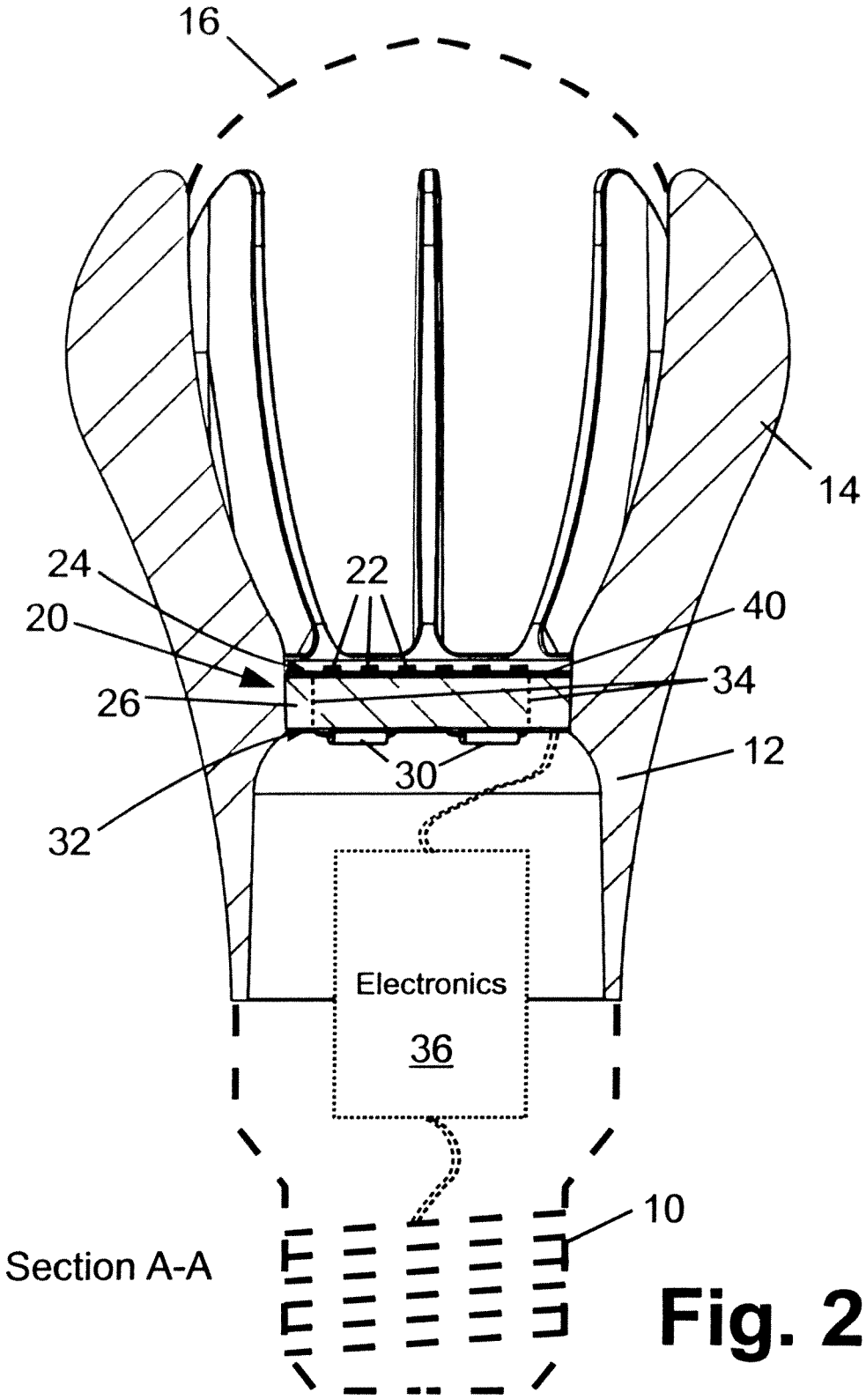
FIG. 2 is a cross-section view of the lamp of FIG. 2.

With reference to FIG. 1, an illustrative lamp is shown. The illustrative lamp has an A-line configuration, with an outer profile corresponding to that of a conventional incandescent "light bulb" of the type used in the 40-100 W electrical input power range or higher. FIG. 1 shows the illustrative lamp while FIG. 2 shows a side sectional view of the lamp (Section A-A indicated in FIG. 1). The lamp includes a base 10 which in the illustrative view is an Edison-type threaded or "screw-in" base whose outline is shown in phantom (that is, using dashed lines) in FIGS. 1 and 2. The main body of the lamp is defined by a heat sink 12 having fins 14 and by an optical diffuser 16. Like the lamp base 10, the outline of the optical diffuser 16 is shown in phantom in FIGS. 1 and 2. The diffuser 16 may have a spherical shape ovoid shape, egg-shape (a combination of prolate ovoid and oblate ovoid shapes), a "bulb" shape (mimicking the shape of the glass bulb of a conventional incandescent light bulb) or so forth. The diffuser 16 may optionally also include one or more optical coatings, such as an anti-reflection coating, ultraviolet filtering coating, wavelength-converting phosphor coating, or so forth. In the illustrative A-line lamp, the fins 14 wrap around a lower portion of the optical diffuser 16.

With particular reference to the sectional view of FIG. 2, a light emitting diode (LED) light engine 20 is disposed in a mating receptacle of the heat sink 12. The LED light engine includes one or more LED devices 22 disposed on a front side 24 of an LED light engine substrate 26. The illustrative light engine 20 also includes optional electronics 30 disposed on a back side 32 of the LED light engine substrate 26 that is opposite the front side 24. The electronics 30 are electrically connected with the one or more LED devices 22 by electrical conduits 34 passing through the LED light engine substrate 26. Additionally or alternatively, electronics for operating the one or more LED devices 22 may be included elsewhere, such as a diagrammatically illustrated electronics module 36 disposed in a hollow region of the heat sink 12 and/or a hollow portion of the lamp base 10. In general, the lamp base 10, electronics 30, 36, and one or more LED devices 22 are electrically interconnected to cause the one or more LED devices 22 to emit light responsive to an operative electrical power input to the lamp base 10.

The LED devices 22 may in general be any solid state light emitting devices, such as semiconductor LED devices (e.g., GaN-based LED devices), organic LED devices, semiconductor laser diodes, or so forth. By way of illustrative example, for white light illumination applications the LED devices 22 are suitably GaN-based blue, violet, and/or ultraviolet-emitting LED chips that are optically coupled with a wavelength-converting phosphor (for example, disposed on the LED chips, or on the diffuser 16) to convert the blue, violet, and/or ultraviolet light emission to a white light spectrum (that is, a spectrum that is perceived by a human viewer as being a reasonable approximation of "white" light). The operating LED devices 22 generate heat. The LED devices 22 may include other components commonly used in the art, such as sub-mounts, surface-mount lead frames, or so forth.

The operating LED devices generate heat. Typically, these devices are designed to operate at a maximum diode junction temperature of around 100° C. or lower, although a higher maximum junction temperature is also contemplated. To maintain the LED devices at or below their maximum design temperature, the LED light engine substrate 26 is made to be thermally conductive. Toward this end, the LED light engine substrate 26 comprises a material having a thermal conductivity of at least 10 W/m-K (e.g., stainless steel or titanium), and more preferably a few tens of W/m-K (e.g., steel having thermal conductivity of about 40-50 W/m-K), and more preferably over at least 100 W/m-K (e.g., aluminum having thermal conductivity of over 200 W/m-K, or copper or silver having thermal conductivity of about 400 W/m-K or higher). As used herein, the various metals are considered to also include alloys thereof, e.g. "copper" when used herein is intended to encompass various copper alloys such as "tellurium copper" as well. As yet another example, some suitable zinc alloys can provide thermal conductivity of order 110 W/m-K. It is also contemplated for the LED light engine substrate 26 to comprise a composite material including nanotubes or carbon fibers, which for suitable types and densities of nanotubes or fibers and suitable host material can achieve still higher thermal conductivity.

In some embodiments, the LED light engine substrate 26 is made of a material that is also electrically conductive. This is the case, for example, for metals such as steel, copper, or aluminum. In such cases, a thin electrically insulating layer 40 is suitably disposed on the front side 24 of the LED light engine substrate 26 to provide electrical insulation of the LED devices 22 from the electrically conductive LED light engine substrate 26. It is also to be appreciated that the LED light engine substrate 26 may in some embodiments comprise a multi-layer structure. For example, in some embodiments the LED light engine 20 includes a conventional metal-core printed circuit board (MCPCB) having a thin metal back plate that is soldered or otherwise thermally and mechanically bonded to a thicker metal disk or plate—in this case the LED light engine substrate 26 includes both the metal disk or plate and the metal core of the MCPCB. Although not illustrated, an electrically insulating layer may also be provided on the back side 32 of the LED light engine substrate 26 in order to electrically isolate the back side electronics 30. Similarly, if the LED light engine substrate 26 comprises metal or another electrically conductive material, then the electrical conduits 34 should include suitable insulation to prevent electrical shunting to the substrate 26.

Figure 3:
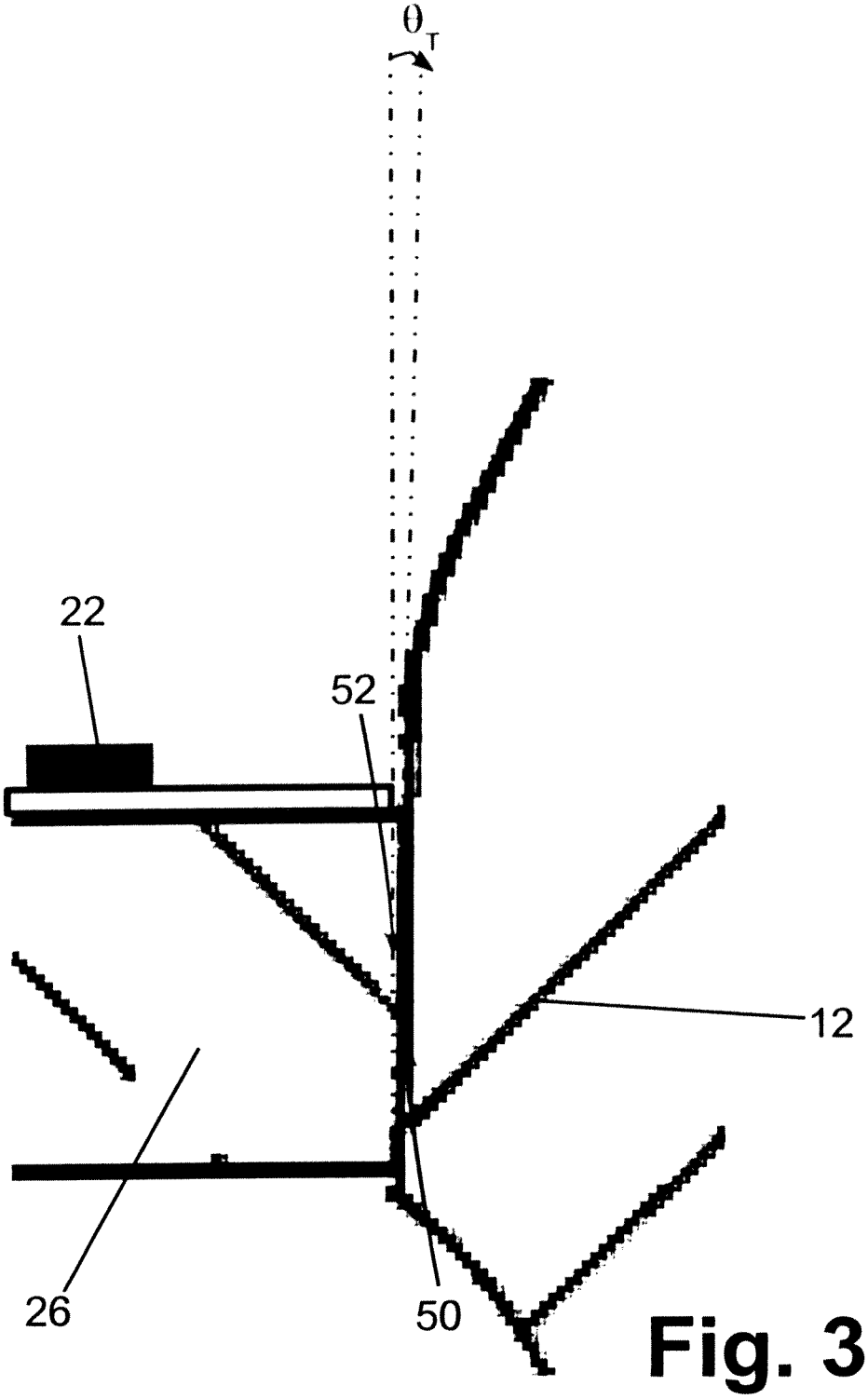
FIGS. 3-5 are detailed views of the light engine mating to the heat sink of the lamp.
Figure 4:
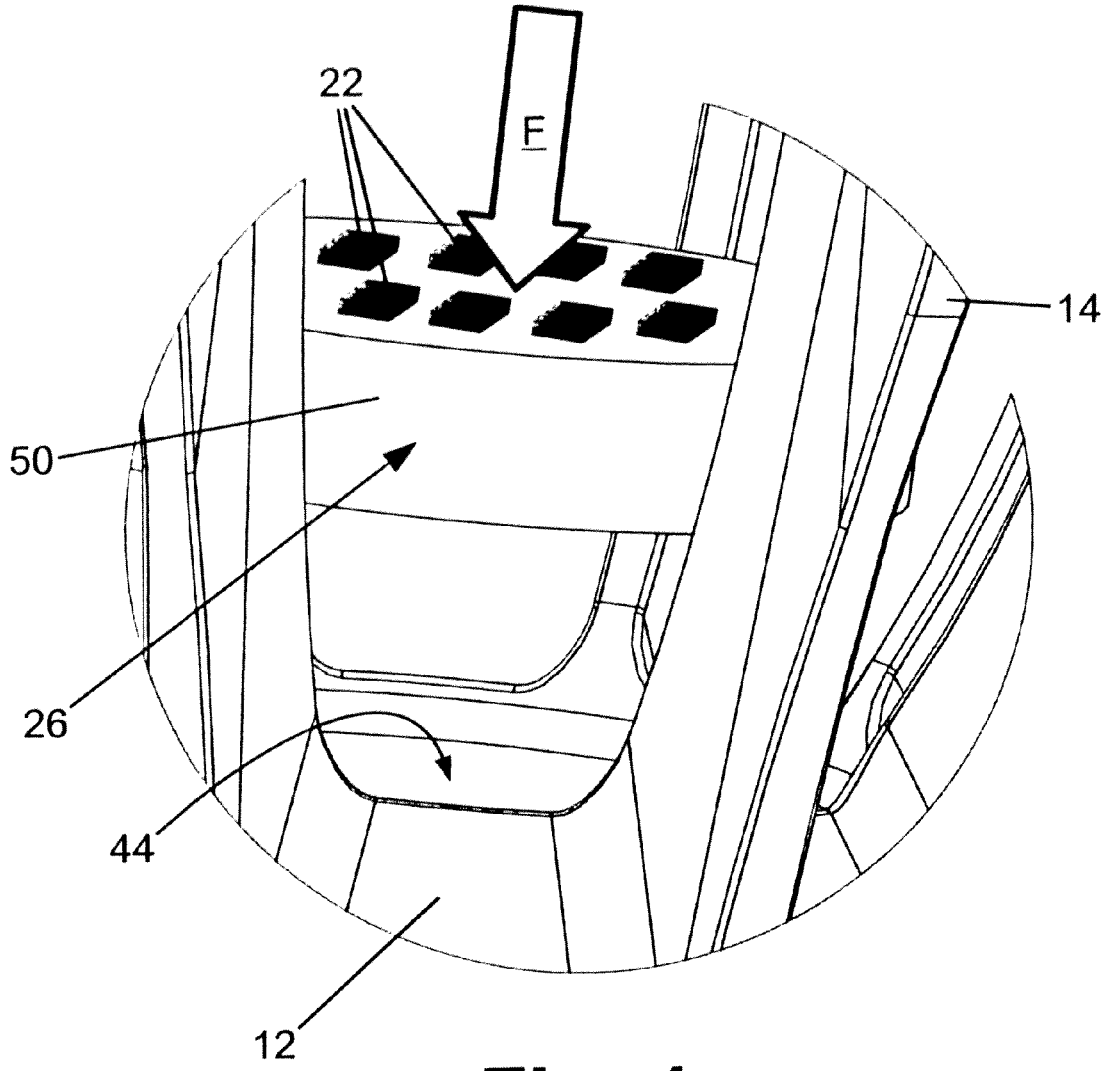

With continuing reference to FIG. 2 and with further reference to FIGS. 3 and 4, the LED light engine 20 is secured into a mating receptacle 44 (labeled in FIG. 4) of the heat sink 12 by a tapered fitting defined by a tapered annular sidewall 50 of the LED light engine substrate 26 and a mating tapered annular sidewall 52 of the mating receptacle 44 of the heat sink 12. As best seen in the enlarged view of FIG. 3, the two tapered surfaces 50, 52 are tapered at a shallow angle $\theta_T$, such that when the LED light engine 20 is pressed into the mating receptacle 44 of the heat sink 12 by a force F (see FIG. 4) the LED light engine 20 is compressively held within the mating receptacle 44 by the tapered fitting. Such a tapered fitting operates similarly to a conically tapered ground glass joint of the type sometimes used in chemical laboratory glassware apparatuses, or tapers used in securing machining drill bit shanks or the like (by way of illustrative example, American Standard Machine tapers or other tapered "quick-change" shanks such as are sometimes used in mounting milling machine arbors, spindles, certain lathe spindles or so forth). The combination of compression of the LED light engine substrate 26 inside the mating receptacle 44 and static friction between the mating tapered surfaces 50, 52 generates a strong retention force that retains the LED light engine 20 in the mating receptacle 44 of the heat sink 12.

A small value for the taper angle $\theta_T$ is advantageous for generating a strong retention force. The taper angle $\theta_T$ is preferably less than 5°, and is more preferably 3° or less. In some suitable embodiments $\theta_T$ is less than 2°, for example 1.75° in one illustrative embodiment and 1.50° in another illustrative embodiment. If the angle $\theta_T$ is small, then an attempted removal force acting in the direction opposite to the illustrated "installation" force F shown in FIG. 4 acts almost in the plane of the two surfaces 50, 52 so that the attempted removal is almost entirely via sliding of the two surfaces 50, 52 against each other. Such sliding motion is resisted by a strong frictional force. The static frictional force can be modeled as $F_{friction} \propto \mu_s \times F_N$ where $F_N$ is the normal force acting normal to the surface and $\mu_s$ is the coefficient of (static) friction. A large normal force $F_N$ exists due to compression of the LED light engine substrate 26 in the mating receptacle 44.

On the other hand, as $\theta_T$ increases, a larger portion (or component) of the attempted withdrawal force acts in the direction normal to the two surfaces 50, 52. This force component draws the surfaces 50, 52 away from each other rather than sliding them against each other, and is therefore not resisted by sliding friction. For a given attempted removal force $F_{remove}$, the component acting parallel with the surfaces 50, 52 (and hence resisted by sliding friction) is $F_{remove} \times \cos(\theta_T)$, while the component acting perpendicular to the surfaces 50, 52 (and hence not resisted by sliding friction) is $F_{remove} \times \sin(\theta_T)$. Thus, a smaller value for $\theta_T$ is generally better. (There is a limit to how small the taper angle $\theta_T$ can be made while still providing an effective taper fitting. This can be seen since at $\theta_T = 0°$ corresponding to no taper at all, there is little or no compressive normal force $F_N$ and hence the static friction force is strongly reduced. Hence, the taper fit should include some tapering at least sufficient to provide the compressive normal force $F_N$).

For a small taper angle $\theta_T$ (e.g., $\theta_T < 5°$, and more preferably $\theta_T \leq 3°$, and still more preferably $\theta_T \leq 2°$) the tapered fitting can provide sufficient retention force without any retention contribution from an adhesive fluid or solder. Moreover, the intimate fit provided by the tapered fitting provides good thermal contact between the surfaces 50, 52, which facilitates effective heat transfer of heat generated by the LED devices 22 from the LED light engine substrate 26 to the heat sink 12 via the tapered fitting. Thus, in some embodiments no adhesive fluid, thermally conductive fluid, or solder is disposed in the tapered fitting. This is advantageous insofar as manufacturing cost and complexity is reduced by eliminating the use of adhesive, solder, screws, or other retention components. However, it is also contemplated to include an adhesive fluid, thermally conductive fluid, or solder in the tapered fitting (e.g., applied before pressing the LED light engine 20 into the mating receptacle 44).

The thermal heat removal pathway for the device of FIGS. 1-4 is conductive from the LED devices 22 to the LED light engine substrate 26, laterally through the LED light engine substrate 26 to the tapered fitting, across the tapered fitting into the heat sink 12, and ultimately to the heat sink fins 14 and thence into the ambient by a combination of convection and radiation. In view of this, the LED light engine substrate 26 should he sufficiently thick so that it can efficiently conduct heat laterally to the tapered fitting. The copper or aluminum back plate of a conventional commercially available MCPCB may be too thin to support sufficient lateral heat transfer. In this case, the MCPCB is suitably soldered or otherwise bonded to a thicker disk-shaped copper (or other thermally conductive) slug to achieve the LED light engine 20 with the desired thickness for the LED light engine substrate 26. Alternatively an insulating layer can be disposed directly onto a disk-shaped copper slug of the desired thickness for the substrate 26, and printed circuitry optionally added, to form the LED light engine 20.

In the embodiment of FIGS. 1-4, the use of a small taper angle $\theta_T$ (e.g., $\theta_T<5°$, and more preferably $\theta_T\leq3°$, and still more preferably $\theta_T\leq2°$) provides strong retention force based on the resistance of sliding friction made large by the (almost) normal compressive force exerted on the mating surfaces 50, 52. This strong retention force is obtained with the surfaces 50, 52 being substantially smooth surfaces. The retention force can be made still larger by providing roughening, texturing, or microstructures on one or both surfaces to further assist in the retention.

Figure 5:
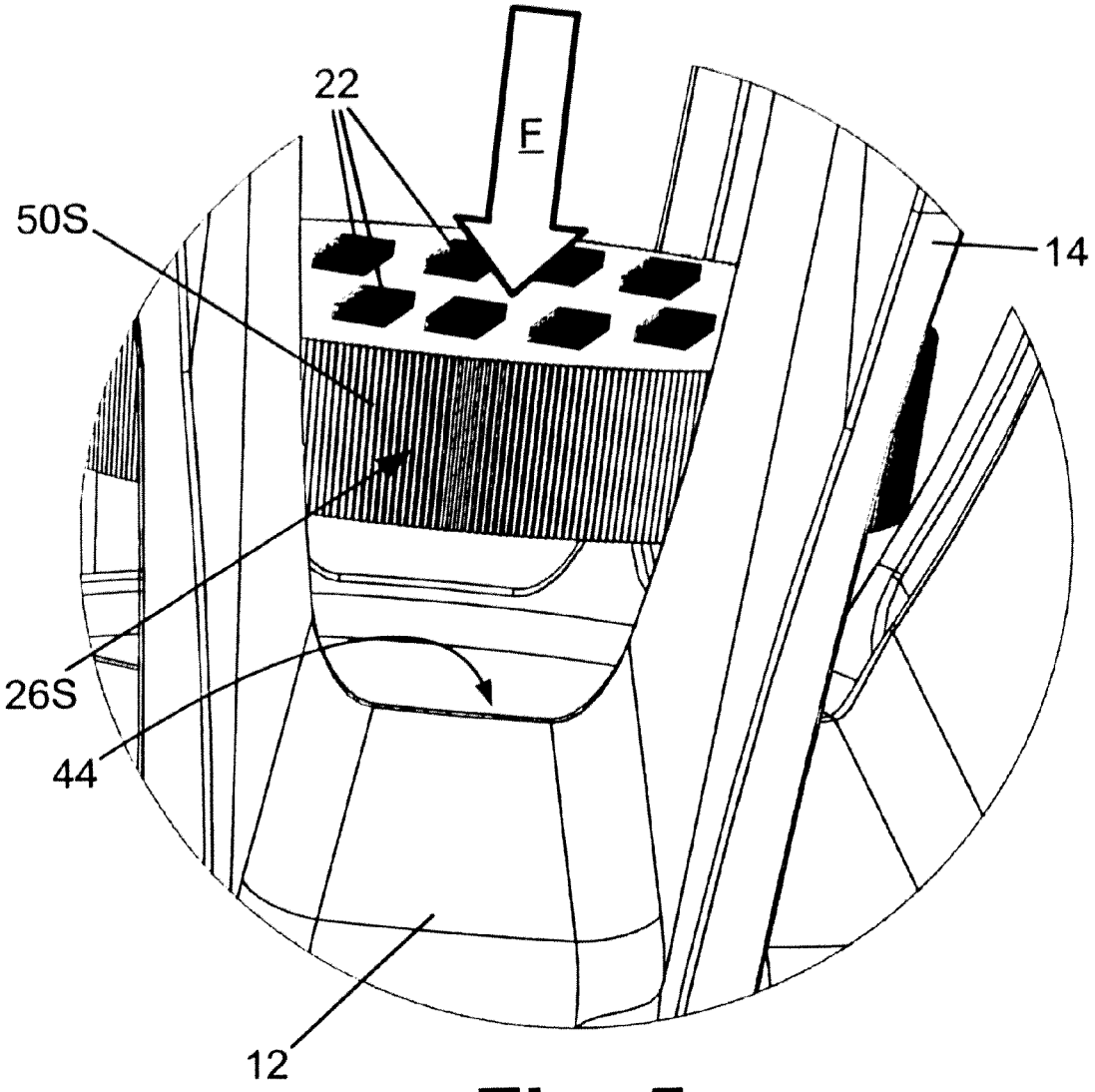
Figure 6:
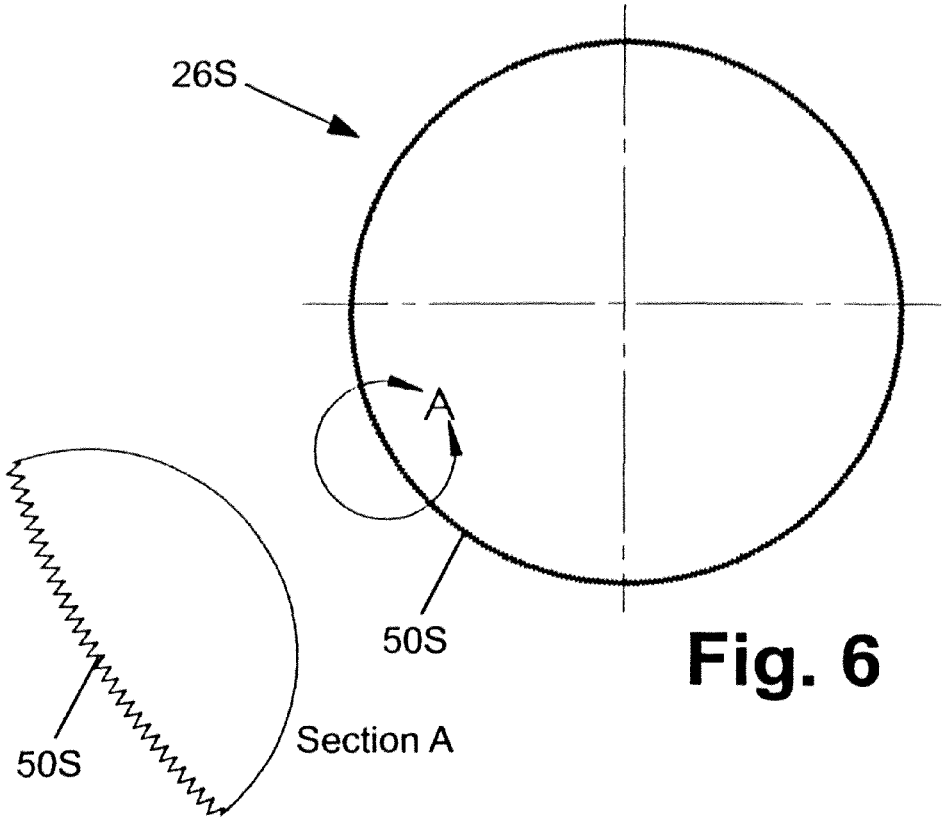
FIGS. 6-7 are detailed views of the light engine.
Figure 7:
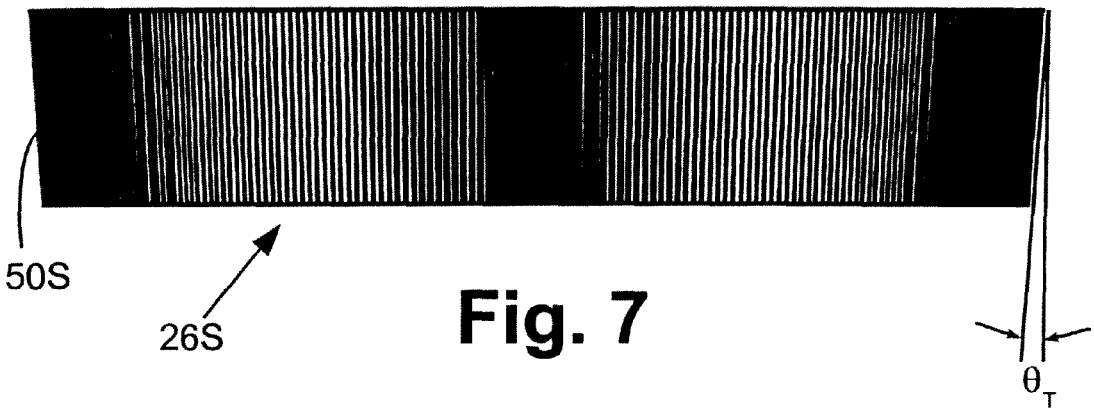

With reference to FIGS. 5, 6, and 7, a variant embodiment is illustrated, in which the smooth tapered annular sidewall 50 of the LED light engine substrate 26 is replaced in a variant LED light engine substrate 26S by an annular sidewall 50S that includes tapered spline microstructures. In this embodiment, is preferable for the annular sidewall 50S to be relatively harder than the annular sidewall 52 of the mating receptacle 44 of the heat sink 12. In this way, the relatively harder tapered surface 50S that includes the features (e.g., spline microstructures in the illustrative embodiment of FIGS. 5-7) deforms (or "bites into") the relatively softer tapered surface 52 in the tapered fitting, thus providing enhanced retention. Instead of the illustrative spline microstructures, an irregular roughening or texturing, or some other type of microstructures, could be used.

Figure 8:
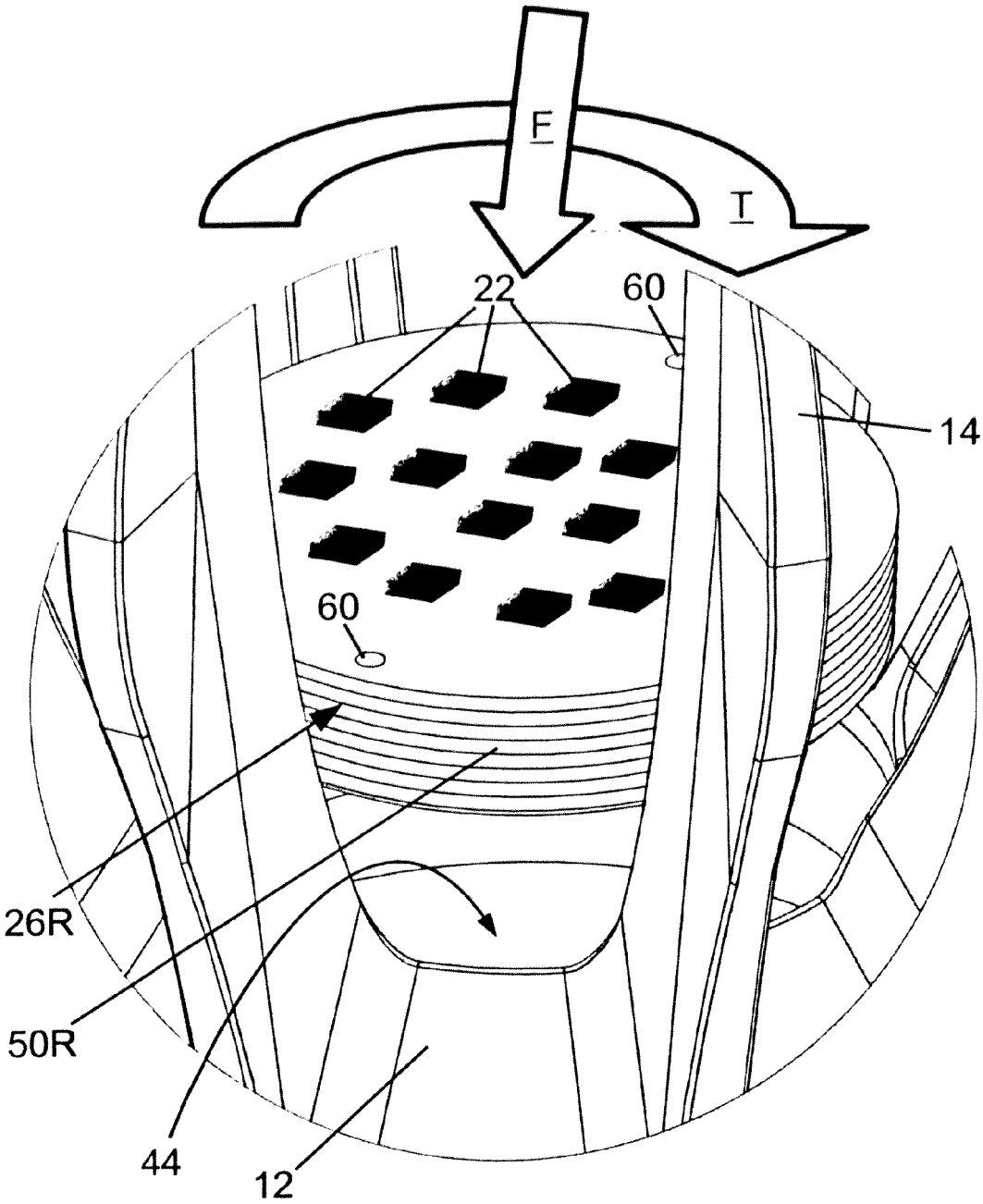
FIGS. 8-9 are detailed views of an alternate light engine embodiment showing a mating to the heat sink of the lamp.
Figure 9:
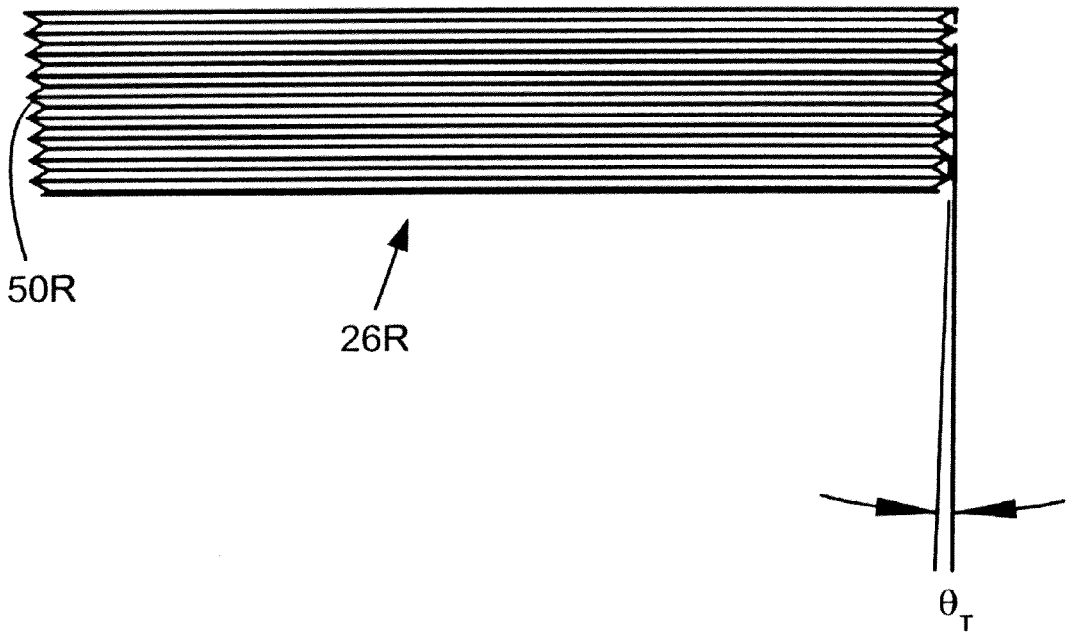

With reference to FIGS. 8 and 9, in another illustrative embodiment an LED light engine substrate 26R is similar to the LED light engines 26, 26S except that a variant annular sidewall 50R includes a tapered threading. In the embodiment of FIGS. 8 and 9 the annular sidewall 52 of the mating receptacle 44 of the heat sink 12 remains smooth. During the installation, in addition to applying the pressing force F an additional rotational force or torque T is applied to cause the tapered threading of the annular sidewall 50R to "bite into" the (presumed to be softer) smooth sidewall 52. Thus, the installation operates similarly to the way a wood screw bites into wood as it is pressed and rotated by the screwdriver. The resulting tapered fit includes the tapered threading of the annular sidewall 50 of the LED light engine substrate 26R mating with a corresponding threading structure formed (or deformed) into the annular sidewall 52 during the installation. In the illustrative example, the torque T (and possibly also the force F) is applied by a spanner wrench (not illustrated) that connects with spanner wrench holes 60 formed into the LED light engine substrate 26R. Note also that as the threading bites into the annular sidewall 52 of the mating receptacle 44 during rotation, this operation may itself exert a portion (or even all) of the pressing force F.

In the embodiment of FIGS. 8 and 9, it is assumed that the annular sidewall 52 of the mating receptacle 44 of the heat sink 12 is smooth (at least prior to its deformation by the threaded sidewall 50 during installation of the LED light engine). In a further variant embodiment (not illustrated), it is assumed that the sidewall 52 also includes an (a priori formed) threading that mates with the threading of the annular sidewall 50R of the LED light engine substrate 26R. This embodiment of the tapered fitting operates similarly to a tapered pipe fitting (e.g., an NPT pipe fitting).

Figure 10:
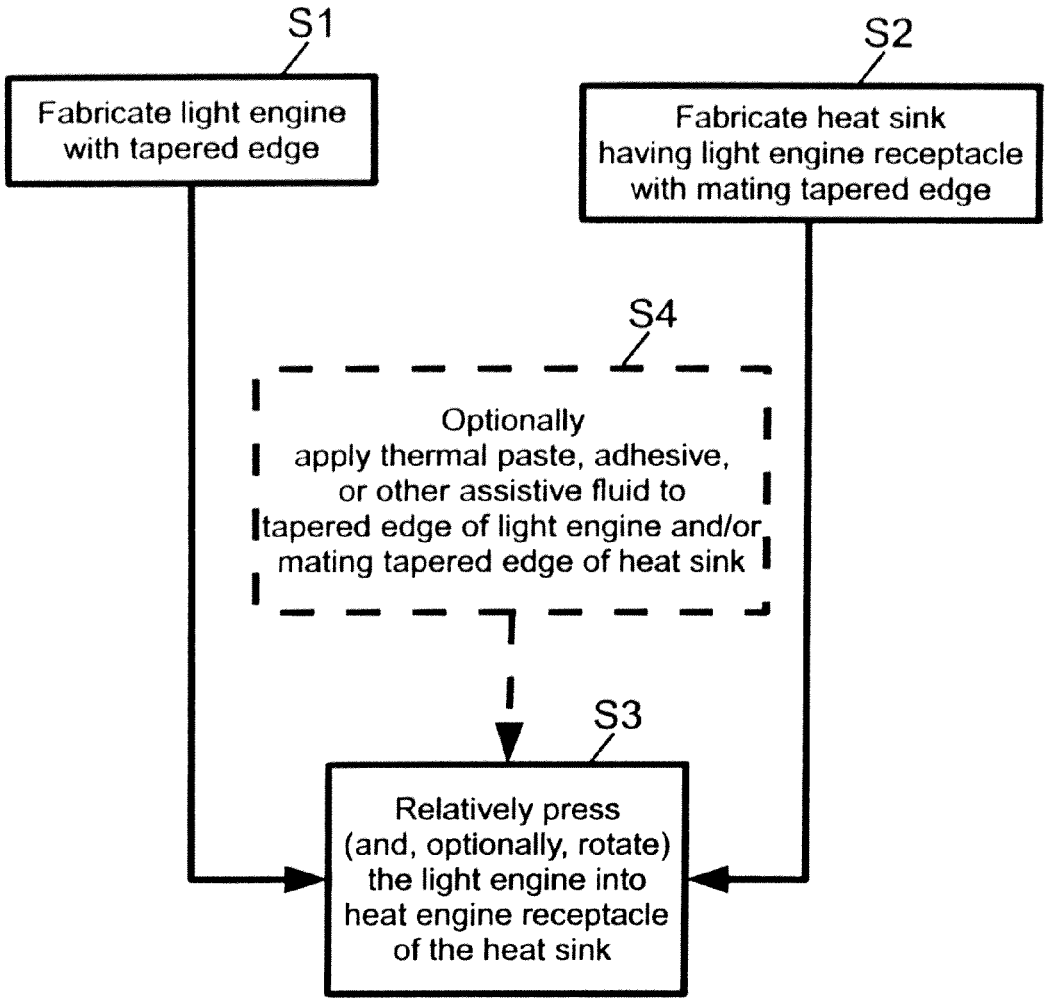
FIG. 10 is a block diagram representing a manufacturing flow chart.

FIG. 10 diagrammatically shows the installation process. The LED light engine 20 is formed in an operation S1, with the LED light engine substrate 26, 26S, 26R including the tapered annular sidewall 50, 50S, 50R. Separately, the heat sink 12, 14 is formed in an operation S2, with the mating receptacle 44 including the tapered sidewall 52. The operations S1, S2 can use any suitable process for forming the tapered sidewalls 50, 52, such as defining these surfaces in a cast (in a casting operation), or using grinding, milling, laser-cutting, or so forth to form the sidewalls 50, 52 after fabrication of the initial components. In an operation S3 the LED light engine is pressed into the mating receptacle of the heat sink, thus engaging a tapered fitting by which the LED light engine is retained in the mating receptacle of the heat sink. Optionally, (e.g., as per the embodiment of FIGS. 8 and 9) the operation S3 may also include applying a rotational force or torque.

As already noted, the tapered fit is generally expected to provide sufficient retention force. However, as also noted, an optional operation S4 may be applied before, during, or after the operation S3, in which the operation S4 includes applying thermal paste, adhesive, solder, or another assistive fluid to the tapered sidewall 50, 50S, 50R of the LED light engine and/or to the tapered sidewall 52 of the mating receptacle 44 of the heat sink 12 in order to further assist in the retention.

In the embodiments of FIGS. 5-9, roughening, texturing, or microstructures are applied to the sidewall 50 of the LED light engine, while the sidewall 52 of the mating receptacle 44 of the heat sink 12 is assumed to be smooth. However, this order can be reversed—that is, the roughening, texturing, or microstructures can be located on the sidewall of the mating receptacle of the heat sink while the sidewall of the LED light engine may remain smooth. Still further, both surfaces of the tapered fit may include roughening, texturing, or microstructures.

In the illustrative embodiments of FIGS. 1-9, the LED light engine substrate 26, 26S, 26R is a planar LED light engine substrate having a perimeter (that is, sidewall 50, 50S, 50R) defining one surface of the tapered fitting. More particularly, in the embodiment of FIGS. 1-9 the LED light engine substrate 26, 26S, 26R is a disk-shaped LED light engine substrate having a circular perimeter (that is, sidewall 50, 50S, 50R) defining one surface of the tapered fitting. However, the perimeter defining one surface of the tapered fitting can be other than circular (except in embodiments employing rotating threading, e.g. FIGS. 8-9). For example, the LED light engine substrate may have a square perimeter with the heat sink having a square mating receptacle. Similarly the LED light engine substrate can be other than planar—for example, the front surface may include some convex curvature to provide light emission over a larger solid angle, and/or the back side may include some structure for supporting electronics or other components.

In the illustrative embodiments of FIGS. 1-9, the LED light engine is supported in the heat sink only by the tapered fitting, that is, only by the mating sidewalls 50, 52. However, it is also contemplated to include an annular lip on the mating receptacle of the heat sink to provide a mechanical stop for the tapered fitting. The direction of the tapering can also be reversed.

Figure 11:
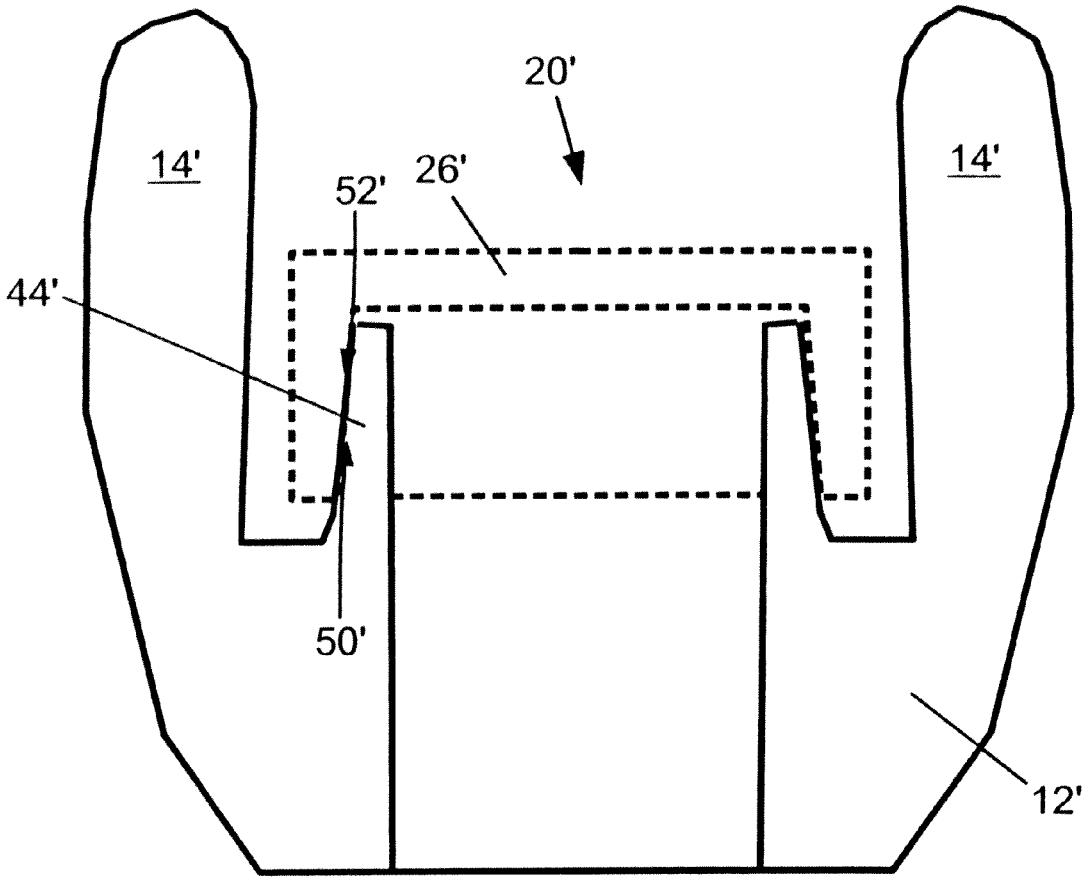
FIG. 11 is a further alternative embodiment showing a light engine mating to a heat sink of the lamp.

With reference to FIG. 11, in yet another contemplated variation, the male/female order of the tapered fitting can be reversed. In the embodiments of FIGS. 1-9, the LED light engine 20 is the male component fitting into the mating receptacle 44 which is an opening in these embodiments. The LED light engine is thus compressively held inside the heat sink in these embodiments. In FIG. 11, a variant heat sink 12' includes a mating receptacle 44' in the form of an annular ring having its surface 52' that contributes to the tapered fitting on the outside. The variant LED light engine 20 includes a variant LED light engine substrate 26' having an annular ring defining a mating surface 50' that contributes to the tapered fitting on the inside. (Note that for simplicity no other details of the LED light engine 20' are shown in FIG. 11, and moreover the diagrammatic LED light engine 20' is shown in dashed lines to distinguish from the diagrammatic heat sink 12'). In this embodiment the LED light engine substrate 26' serves as the female part of the tapered fitting and the heat sink 12' (and more particularly the mating receptacle 44') serves as the male part of the tapered fitting.

The illustrative embodiments have been described in the context of an illustrative A-line lamp. However, the disclosed approaches for assembling an LED light engine to a heat sink are suitably employed in other types of LED-based lamps, such as in directional LED-based lamps (e.g., MR, R, or PAR lamps) as well as in other types of LED-based luminaires (e.g. modules, downlights, and others).

Additional disclosure is provided herein in the form of the following one-sentence statements of various disclosed aspects, written in patent claim form, where the use of multiple claim dependencies is intended to disclose various contemplated combinations of features.

The invention claimed is:

1. An apparatus comprising:

a light emitting diode (LED) light engine comprising a disc-shaped body having a front side including a circular perimeter defining a circular sidewall, one or more LED devices disposed on the front side of an LED light engine substrate, said sidewall being inwardly tapered from a first edge adjacent to the front side to a second edge adjacent an opposed back side, said front side having a diameter greater than a distance between the first edge and the second edge, said LED devices illuminating an interior of an at least substantially spherical optical diffuser;

a heat sink having a mating receptacle for the LED light engine said heat sink including a plurality of fins each having an interior edge facing at least a first portion of said optical diffuser, the LED light engine substrate and the mating receptacle of the heat sink defining a tapered fitting along the interior edges by which the LED light engine is retained in the mating receptacle of the heat sink along only said interior edges of said fins which form the tapered fitting; and wherein the LED light engine substrate has a back side opposite the front side, at least a central area of the back side of the LED light engine not contacting the heat sink; and wherein said heat sink further defines a hollow region, said hollow region forming an open space adjacent the back side of the LED light engine substrate.

2. The apparatus of claim 1, wherein the LED light engine substrate comprises a material having a thermal conductivity of at least 10 W/m-K.

3. The apparatus of claim 1, wherein the LED light engine substrate is electrically conductive and the LED light engine further comprises an electrically insulating layer disposed on the front side of the LED light engine that electrically insulates the one or more LED devices from the LED light engine substrate.

4. The apparatus of claim 1, wherein the LED light engine further comprises one or more electronic components disposed on the back side of the LED light engine substrate and electrically connected with the one or more LED devices disposed on the front side of the LED light engine.

5. The apparatus of claim 1, wherein no portion of the back side of the LED light engine substrate contacts the heat sink.

6. The apparatus of claim 1, wherein an outer annulus of the back side of the LED light engine substrate contacts the heat sink.

7. The apparatus of claim 1, wherein the LED light engine substrate contacts the heat sink only at the tapered fitting.

8. The apparatus of claim 1, wherein the LED light engine substrate defines a male portion of the tapered fitting and the heat sink defines a female portion of the tapered fitting.

9. The apparatus of claim 1, wherein the mating receptacle of the heat sink comprises an mating opening into which the LED light engine substrate fits with the tapered fitting comprising an outer periphery of the LED light engine substrate that compressively fits inside the mating opening of the heat sink.

10. The apparatus of claim 1, wherein the tapered fitting has a taper angle of less than 5°.

11. The apparatus of claim 1, wherein the tapered fitting has a taper angle of less than 3°.

12. The apparatus of claim 1, wherein the tapered fitting comprises:

one of (1) a surface of the LED light engine substrate that contributes to defining the tapered fitting and (2) a surface of the heat sink that contributes to defining the tapered fitting consisting of a softer surface relative to a cooperative mating surface which is the other surface of (1) or (2); and the other of (1) the surface of the LED light engine substrate that contributes to defining the tapered fitting and (2) the surface of the heat sink that contributes to defining the tapered fitting consisting of a harder surface relative to a cooperative mating surface which is the other surface of (1) or (2).

13. The apparatus of claim 12, wherein the harder surface includes features that deform the relatively softer surface in the tapered fitting.

14. The apparatus of claim 13, wherein the features that deform the softer surface in the tapered fitting comprise tapered splines.

15. The apparatus of claim 13, wherein the features that deform the softer surface in the tapered fitting comprise a tapered threading.

16. The apparatus of claim 1, wherein at least one of (1) the surface of the LED light engine substrate that contributes to defining the tapered fitting and (2) the surface of the heat sink that contributes to defining the tapered fitting includes roughening, texturing, or microstructures.

17. The apparatus of claim 16, wherein the at least one surface including roughening, texturing, or microstructures includes tapered splines or a tapered threading.

18. The apparatus of claim 1, wherein the LED light engine is retained in the mating receptacle of the heat sink by the tapered fitting without any retention contribution from an adhesive fluid or solder.

19. The apparatus of claim 1, wherein the apparatus includes an outer periphery at least substantially the same as an outer periphery of an A-line lamp.

20. A method comprising:

constructing a light emitting diode (LED) light engine comprising a disc-shaped body having a front side including a circular periphery defining a circular sidewall, one or more LED devices disposed on a front side of an LED light engine substrate, said sidewall being inwardly tapered from a first edge adjacent to the front side to a second edge adjacent to an opposed back side, said front side having a diameter greater than a distance between the first edge and the second edge, said LED devices illuminating an interior of an at least substantially spherical optical diffuser; and pressing together the LED light engine and a mating receptacle of a heat sink, said heat sink including a plurality of fins each having an interior edge facing at least a first portion of said optical diffuser, the pressing at least contributing to engaging a tapered fitting by deforming an engaging surface of one of the LED light engine and the heat sink fin interior edges by which the LED light engine is retained in the mating receptacle of the heat sink along only said interior edges of said fins which form the tapered fitting.

21. The method of claim 20, further comprising:

rotating the LED light engine relative to the heat sink during the pressing, the rotating also contributing to engaging the tapered fitting by which the LED light engine is retained in the mating receptacle of the heat sink.

22. The apparatus of claim 1 wherein said LED light engine substrate includes a sidewall having an at least substantially constant taper from the first edge to the second edge.

23. An apparatus comprising:

a light emitting diode (LED) light engine comprising one or more LED devices disposed on a front side of an LED light engine substrate, said LED devices illuminating an interior of an at least substantially spherical optical diffuser, a heat sink having a plurality of fins defining a mating receptacle for the LED light engine, the plurality of fins having a first edge directly receiving the LED light engine substrate, said first edges of the plurality of fins surrounding at least a first portion of said optical diffuser, the LED light engine substrate and the mating receptacle of the heat sink defining a tapered fitting by which the LED light engine is compressively retrained by only the first edges of the plurality of fins in the mating receptacle of the heat sink and said heat sink further defines a hollow region, said hollow region forming an open space adjacent the back side of the LED light engine substrate.

* * * * *